US007648734B2

(12) United States Patent
Machida et al.

(10) Patent No.: US 7,648,734 B2
(45) Date of Patent: Jan. 19, 2010

(54) APPARATUS FOR FORMING THIN FILM AND METHOD FOR FORMING THE SAME

(75) Inventors: Osamu Machida, Ibaraki (JP); Makoto Kurosawa, Ibaraki (JP); Kazuo Shimizu, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 691 days.

(21) Appl. No.: 11/237,906

(22) Filed: Sep. 29, 2005

(65) Prior Publication Data

US 2006/0121189 A1 Jun. 8, 2006

(30) Foreign Application Priority Data

Sep. 30, 2004 (JP) ..... P2004-288939

(51) Int. Cl.
*B05D 1/00* (2006.01)
*B05B 13/02* (2006.01)

(52) U.S. Cl. ..... 427/209; 118/305; 118/325; 427/402

(58) Field of Classification Search ..... 118/305, 118/300, 313–316, 321, 323, 325; 347/20, 347/40, 47, 101, 104, 107; 427/162, 168, 427/209, 210, 58, 63, 402, 411, 115; 355/75, 355/88; 438/125
See application file for complete search history.

(56) References Cited

U.S. PATENT DOCUMENTS

2004/0009303 A1 * 1/2004 Ito et al. ..... 427/421
2004/0131782 A1 * 7/2004 Hasei et al. ..... 427/337

FOREIGN PATENT DOCUMENTS

JP 2001-504755 4/2001

* cited by examiner

*Primary Examiner*—Yewebdar T Tadesse
(74) *Attorney, Agent, or Firm*—McGinn IP Law Group, PLLC

(57) ABSTRACT

To coat a solution on both surfaces continuously in such a state that an edge portion of the substrate is so constructed as to be fixed, and the substrate is attached to a substrate fixing frame having a positioning mechanism.

17 Claims, 6 Drawing Sheets

APPARATUS FOR FORMING THIN FILM AND METHOD FOR FORMING THE SAME

BACKGROUND OF THE INVENTION

1. Field of the Invention

The present invention relates to an apparatus for forming a thin film and a method for forming a thin film by coating a coating composition on a surface of a substrate.

2. Description of the Related Art

A coating method using a liquid jet head has been expanded in rang of application because of its property of precisely coating an accurate amount of small droplets on a predetermined position, and has been used for coating various solutions not only on paper but also on films or metals as organic materials.

As a method for forming a coating film on organic materials, such as a coating method is disclosed that catalyst or adsorption materials are coated on an electrolyte film used in a contaminant disposing apparatus for removing contaminants from gas (see, for example, Japanese translation of PCT international application 2001-504755).

SUMMARY OF THE INVENTION

However, in the case of coating catalyst materials by liquid jet technology, it is necessary to lower the viscosity of the solution compared with the case of coating by screen printing. Thus, in the case of coating catalyst materials on an electrolyte film, the electrolyte film swells due to penetration of the solvent in the film to cause such a phenomenon as wrinkling. Therefore, there has been a defect of difficulty in uniform coating.

In the case of coating films on both surfaces of a substrate, dimensional change of an electrolyte film occurs due to swelling and drying of the film upon coating on one surface thereof. Therefore, there has been a defect of difficulty in positioning.

According to an aspect of the invention, there is provided with an apparatus for forming a thin film by coating a coating composition on a film substrate, the apparatus including: an ink jet mechanism having a liquid jet head for jetting the coating composition on the substrate; a moving mechanism capable of moving a position of the liquid jet head relatively to the film substrate; a substrate fixing frame capable of fixing an edge portion of the film substrate; and a substrate holder having a mechanism for fixing and positioning the substrate fixing frame having the film substrate attached, and a mechanism for sucking the film substrate from a reverse side of a surface to which the coating composition is coated.

According to another aspect of the invention, there is provided with a method for forming a thin film, the method including: coating a coating composition on a first surface of the film substrate which is attached to the substrate fixing frame using the apparatus according to the above-aspect; subsequently inverting the film substrate while being attached to the substrate fixing frame; and coating a coating composition on a reverse side of the first surface.

According to the above-aspects, it is possible to inhibit occurrence of wrinkling and the like due to swelling of a film substrate to form a uniform coating film.

According to another aspect of the invention, there is provided with a method of forming a thin film by coating a coating composition on a film substrate, the method including: coating a coating composition on a first surface of the film substrate which is attached to the substrate fixing frame using the apparatus according to the above-aspect; subsequently inverting the film substrate while being attached to the substrate fixing frame; and coating a coating composition on a reverse side of the first surface by using the substrate fixing frame having a mechanism capable of positioning relating to the coating pattern of the first surface.

According to the above-aspects, it is possible to form a uniform coating film on both surfaces of a film substrate precisely in positioning.

According to the above-aspects, the substrate fixing frame holding an edge of a thin substrate is used, therefore, it is possible to prevent occurrence of wrinkling and pattern deformation of the substrate due to swelling on coating.

In addition, since the substrate fixing frame having a positioning mechanism is used, the identical patterns can be readily formed on the same positions on both surfaces of the film substrate. Therefore, it is possible to improve the capability of functional membranes such as catalyst coating on an electrolyte film.

Further, in the field of ornaments and the like, it is possible to print pictures or characters on both surfaces of a transparent film easily and efficiently.

DESCRIPTION OF THE PREFERRED EMBODIMENTS

A coating method of a catalyst solution on an electrolyte film used in a catalyst apparatus and the like will be described in the following as an embodiment of the invention.

Figure 1:
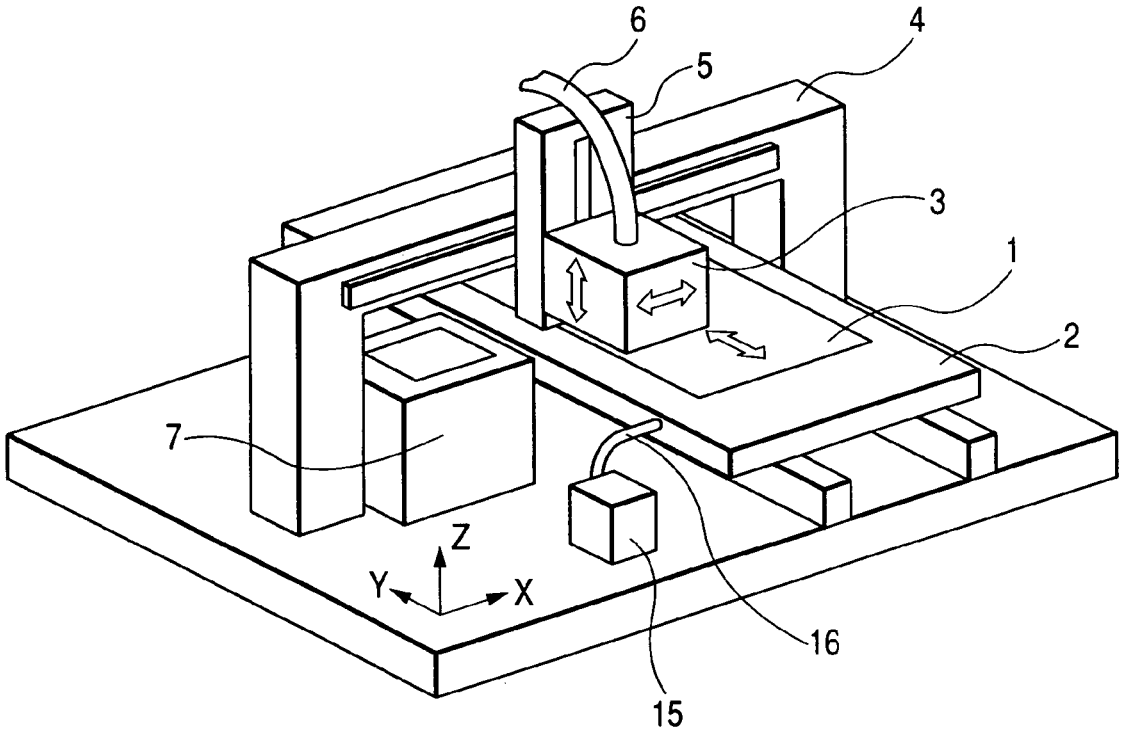
FIG. 1 is a schematic perspective view of an apparatus for forming a thin film of the embodiment.

FIG. 1 is a schematic perspective view showing summary of an apparatus for forming a thin film according to the embodiment. The apparatus includes a substrate holder 2 having an adsorption function for holding a film substrate 1 to which a catalyst solution is coated, and a liquid jet head part 3 (Hereinafter, referred to as "an ink jet head part 3") for coating the solution is attached to the upper part of the substrate holder 2. The ink jet head part 3 houses a liquid jet head (hereinafter, referred to as "an ink jet head") having plurality of nozzles and a driver for driving the ink jet head.

Figure 6:
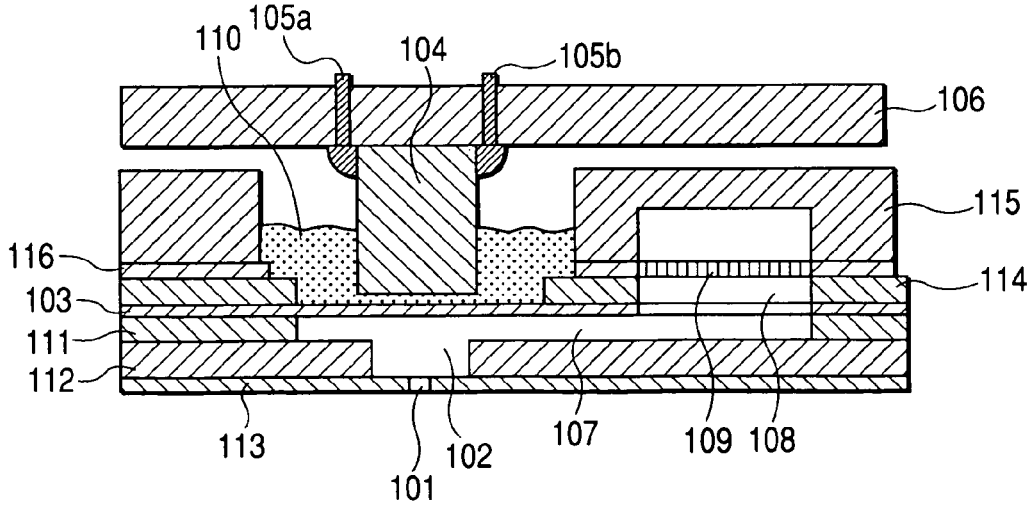
FIG. 6 is a cross-sectional view of a liquid jet head of the embodiment.

FIG. 6 is a cross-sectional view showing an embodiment of the nozzle part of the ink jet head according to the embodiment. Numeral 101 denotes an orifice, 102 denotes a pressurizing chamber, 103 denotes a diaphragm, 104 denotes a piezoelectric element, 105*a* and 105*b* each denotes a signal input terminal, 106 denotes a piezoelectric element fixing plate, 107 denotes a restrictor for connecting a common liquid supplying path 108 (Hereinafter, referred to as "a common ink supplying path 108") and the pressurizing chamber 102, and controlling a catalyst solution flow into the pressurizing chamber 102, 108 denotes the common ink supplying path, 109 denotes a filter, 110 denotes an adhesive having elasticity such as a silicon adhesive for connecting the diaphragm 103 and the piezoelectric element 104, 111 denotes a restrictor plate for forming the restrictor 107, 112 denotes a pressurizing chamber plate for forming the pressurizing chamber 102, 113 denotes an orifice plate for forming the orifice 101, 114 denotes a supporting plate reinforcing the diaphragm 103, 115 denotes a housing having the common ink supplying path 108, and 116 denotes a filter plate for forming the filter 109.

The diaphragm 103, the restrictor plate 111, the pressurizing chamber plate 112 and the supporting plate 114 are made, for example, of stainless steel, and the orifice plate 113 is made of nickel or stainless steel. The whole of the surface of these plates is covered with a polyimide film 121, respectively. The piezoelectric element fixing plate 106 is made of an insulator such as ceramics or polyimide. The catalyst solution flowing from upstream to downstream passes through the filter 109 on the way of the common ink supplying path 108, and flows through the restrictor 107, the pressurizing chamber 102, and the orifice 101 in this order. The piezoelectric element 104 expands or contracts when an electric potential difference is applied between the signal input terminals 105*a* and 105*b*, and returns to its original shape before expanding or contracting when the electric potential difference between the signal input terminals 105*a* and 105*b* is removed. Due to the deformation of the piezoelectric element 104, pressure is applied to the catalyst solution in the pressurizing chamber 102, and the catalyst solution is jetted from the orifice 101.

The ink jet head part 3 is attached to an X guide 4 and a Z guide 5 capable of moving in the X and Z directions, respectively, shown in FIG. 1, and the substrate holder 2 is capable of moving in the Y direction, whereby it is possible to coat the catalyst solution to an arbitrary position on the film substrate 2 with an arbitrary distance according to a signal from the head driver. The catalyst solution is continuously supplied from a catalyst solution tank, which is not shown in the drawing, through a solution supplying pipe 6. Upon exchanging film substrates and resting the apparatus, the ink jet head part 3 is moved to a head maintenance part 7 to prevent the solution from drying, and the operation such as cleaning and capping of the surface of the ink jet head part 3, and dummy jetting to dispose an unnecessary solution in some cases, are carried out.

The substrate holder 2 preferably has a heating mechanism attached thereto to prevent swelling. The apparatus mentioned herein has a tape heater attached to the substrate holder 2, and has a structure capable of heating the substrate to 100° C. at maximum.

A step for coating a catalyst solution on an electrolyte film using the apparatus for forming a thin film will be then described. A perfluorosulfonic acid film is generally used as the electrolyte film in many cases. In this embodiment, a film having a thickness of 50 μm of Nafion (trade name: produced by DuPont) is used. A film of perfluorosulfonic acid series has a large ion exchanging capacity, but tends to swell in water or alcohol which is a main solvent of a catalyst solution. Especially, in the case of coating a catalyst solution by an ink jet method, it is necessary to lower its viscosity to 1 to 30 mPa·s, and the phenomenon of swelling is remarkably appeared.

Figure 2:
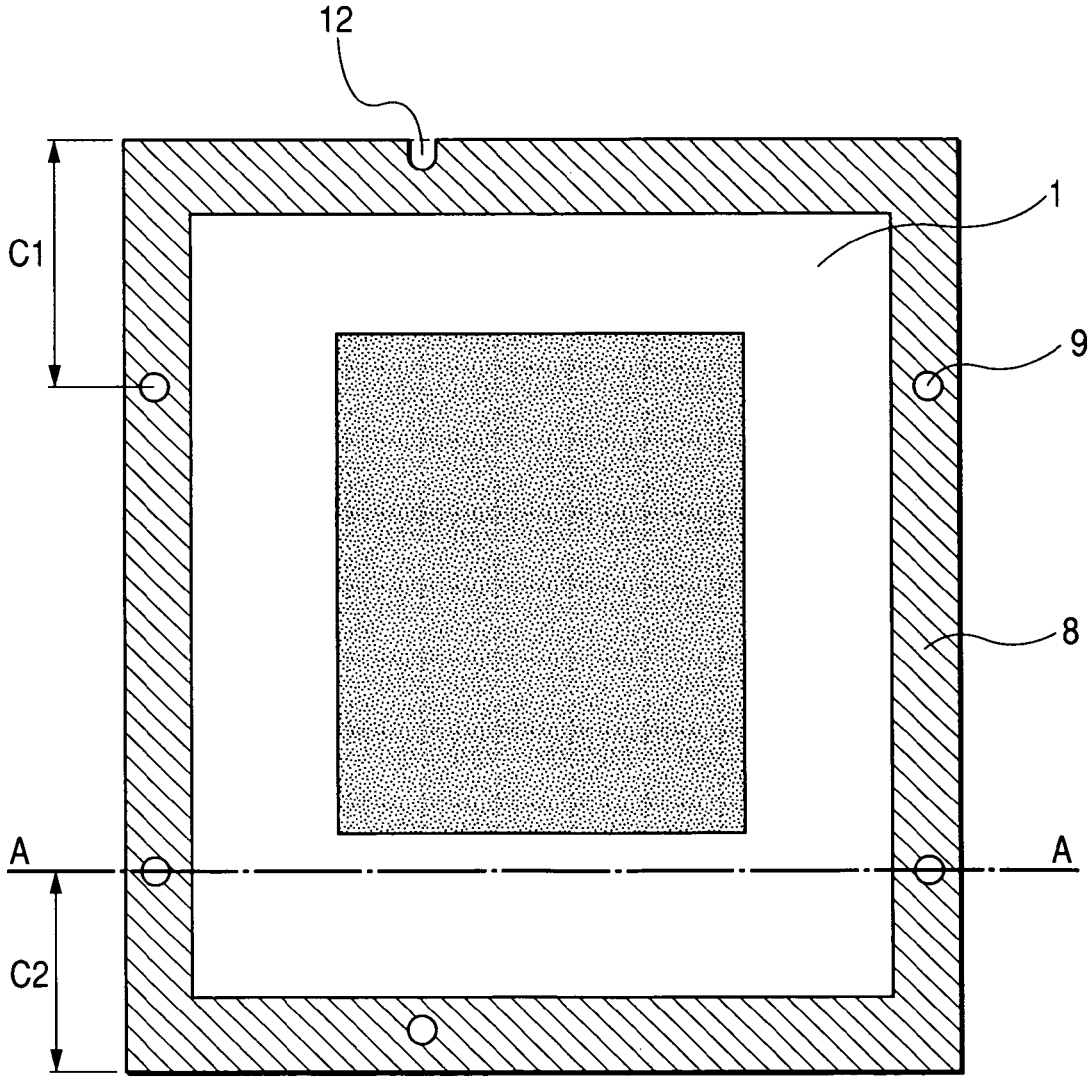
FIG. 2 is a plan view of a substrate fixing frame of the embodiment.

In the apparatus mentioned herein, to prevent the phenomenon, a substrate fixing frame 8 which is produced according to the size of the film substrate 1 shown in FIG. 2 is attached to the whole of peripheral part of the film substrate 1 with an adhesive tape or the like. Positioning holes 9 capable of positioning to the substrate holder 2 of the apparatus are formed on the substrate fixing frame 8, which is fixed by inserting positioning pins 10 of the substrate holder 2 into the positioning holes 9. The film substrate 1 fixed onto the substrate holder 2 is further tightly fixed by a sucking mechanism as described later.

A catalyst solution is charged to the ink jet head part 3 and coated on the first surface on the film substrate with an arbitrary pattern. Although the coating amount of the catalyst solution varies depending on its property, coating is carried out at a density of 30 mg/cm$^2$ in this embodiment. The time and frequency for coating the necessary amount of the catalyst vary depending on the number of nozzles of the ink jet head, the weight of droplets per one nozzle, the jetting frequency, and the moving velocity of the substrate holder 2. In this embodiment, the aforementioned catalyst density can be obtained in the jetting condition in which the number of nozzles is 192, the jetting frequency is 4 kHz and the weight of droplets is 45 ng, and in the coating condition of the moving velocity of the substrate of 200 mm/S.

Figure 3:
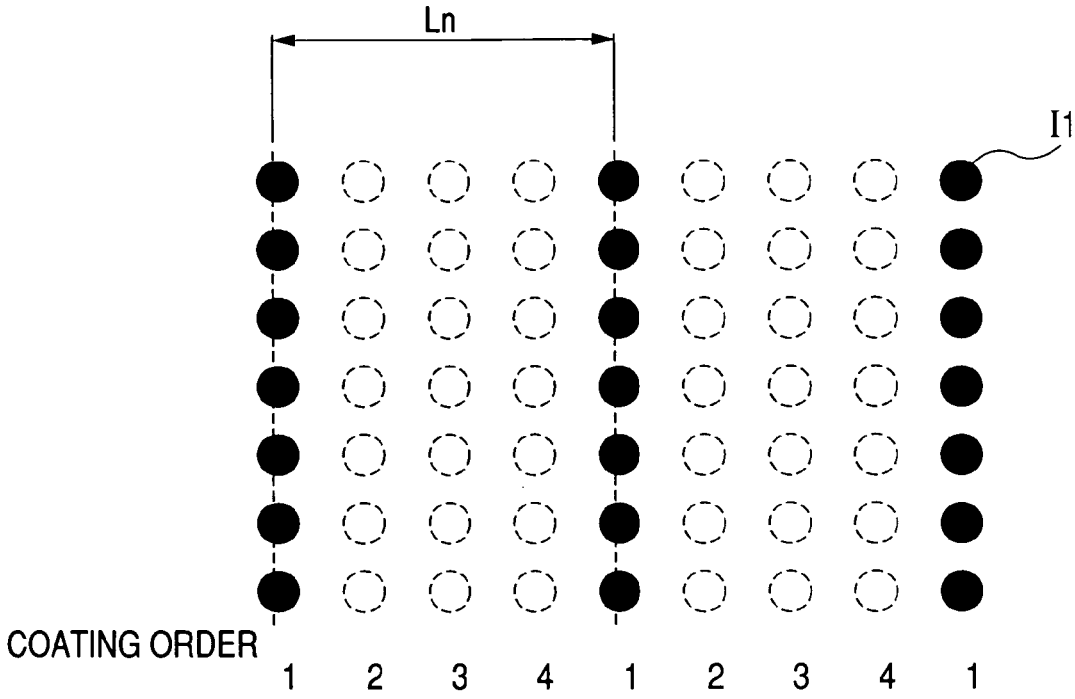
FIG. 3 is a schematic view of a coating pattern of a solution in the embodiment.

An example of a coating method of a catalyst solution for forming a uniform solid film using an ink jet head is shown in FIG. 3. Dots 11 of the solution are formed with an interval Ln of a nozzle pitch in the first coating, and in the second coating or later, it is possible to coat the catalyst solution at the predetermined density by coating it at a suitable space between the dots. While the catalyst is coated in a rectangular pattern in this embodiment, the pattern can be arbitrarily configured, and the coating frequency or density can be changed depending on the position to be coated.

After coating the catalyst on the first surface in a predetermined weight, the film substrate 1 is inverted while being attached to the substrate fixing frame 8, and coating is carried out on the second surface opposite to the first surface. Thus, it is possible to prevent occurrence of wrinkling and the like due to swelling, even in the state that the catalyst solution is coated on one surface. In addition, in order to ensure the catalyst capability, it is necessary to form the pattern on the second surface at the same position on the reverse side as the pattern formed on the first surface.

Figure 4:
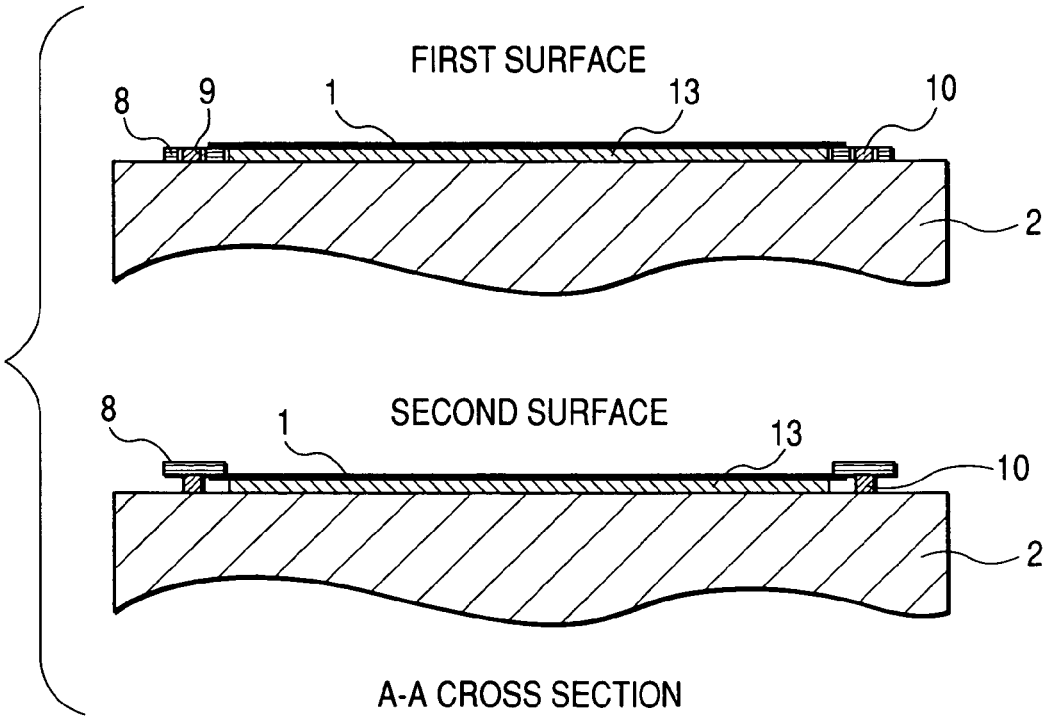
FIG. 4 is a cross-sectional view of a peripheral part of a substrate holder of an embodiment of the invention.
Figure 8:
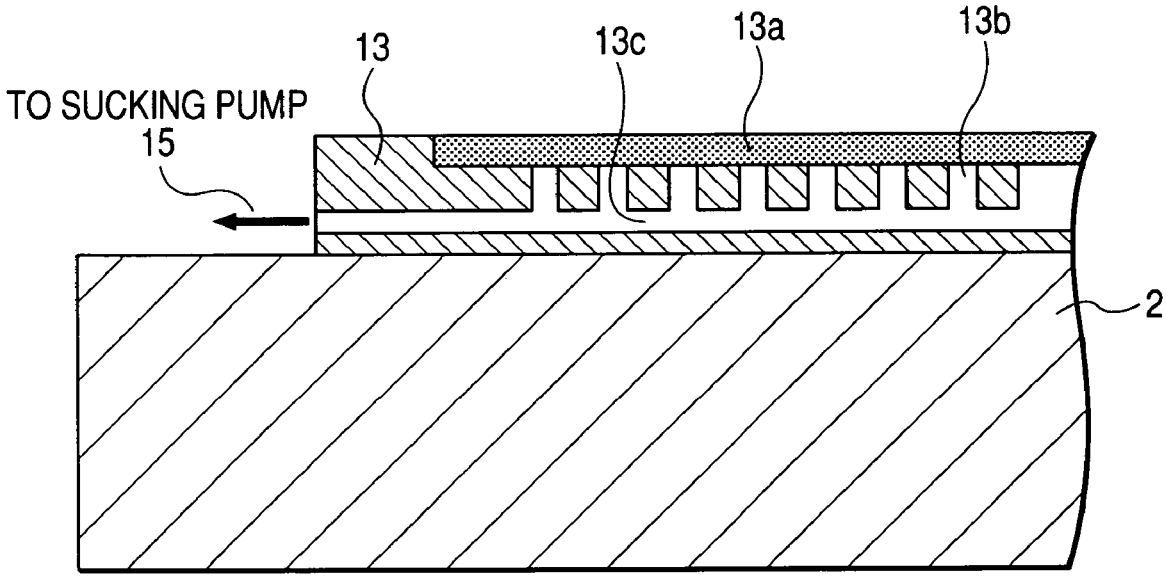
FIG. 8 shows a structure of the sucking mechanism.

As shown in FIG. 2, a guide 12 and five positioning holes 9 are made on the substrate fixing frame 8. On the other hand, as shown in FIG. 4, a step 13 having the same height as the thickness of the substrate fixing frame 8 is disposed on the substrate holder 2, whereby the film substrate 1 and the substrate holder 2 are positioned on the same surface. In the case where the film substrate 1 is inverted on front-back both sides as shown in FIG. 2, the positioning holes 9 which are unsymmetrically disposed on both sides of the substrate fixing frame 8 become unfitted to the positioning pins 10 on the substrate holder 2, whereby the substrate fixing frame 8 is positioned on the positioning pins 10. The one positioning hole 9 is located at an interval C1 from the edge portion of the substrate fixing frame 8. The other positioning hole 9 is located at an interval C2 from the opposite edge portion of the substrate fixing frame 8. In addition, since the heights of the positioning pins 10 and the step 13 on the substrate holder 2 are formed to be equal, the film substrate 1 and the step 13 are positioned on the same surface. FIG. 8 shows a structure of the sucking mechanism. A common sucking path 13*c* connected to a sucking pump 15 through the sucking pipe 16 and a plurality of sucking hole 13*b* connected to the common sucking path 13*c* are inside of the step 13. The plurality of sucking hole 13*b* is located at a predetermined interval on an area corresponding to whole area of the film substrate 1. A mesh plate 13*a* is put on a surface of the step 13. By thus configuration of the sucking mechanism, when the sucking pump starts the sucking operation, the film substrate 1 is sucked from the plurality of sucking hole 13*b* through the mesh plate 13*a*, so that the whole film substrate 1 can be fixed.

Figure 5:
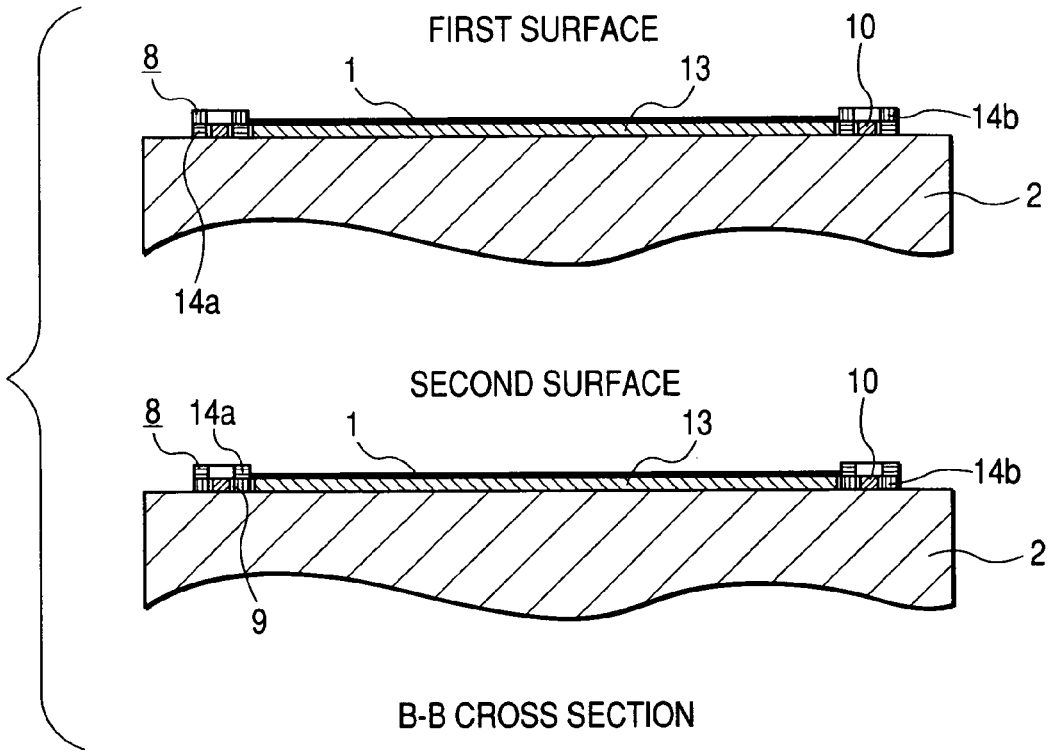
FIG. 5 is a cross-sectional view of a peripheral part of a substrate holder of another embodiment of the invention.
Figure 7:
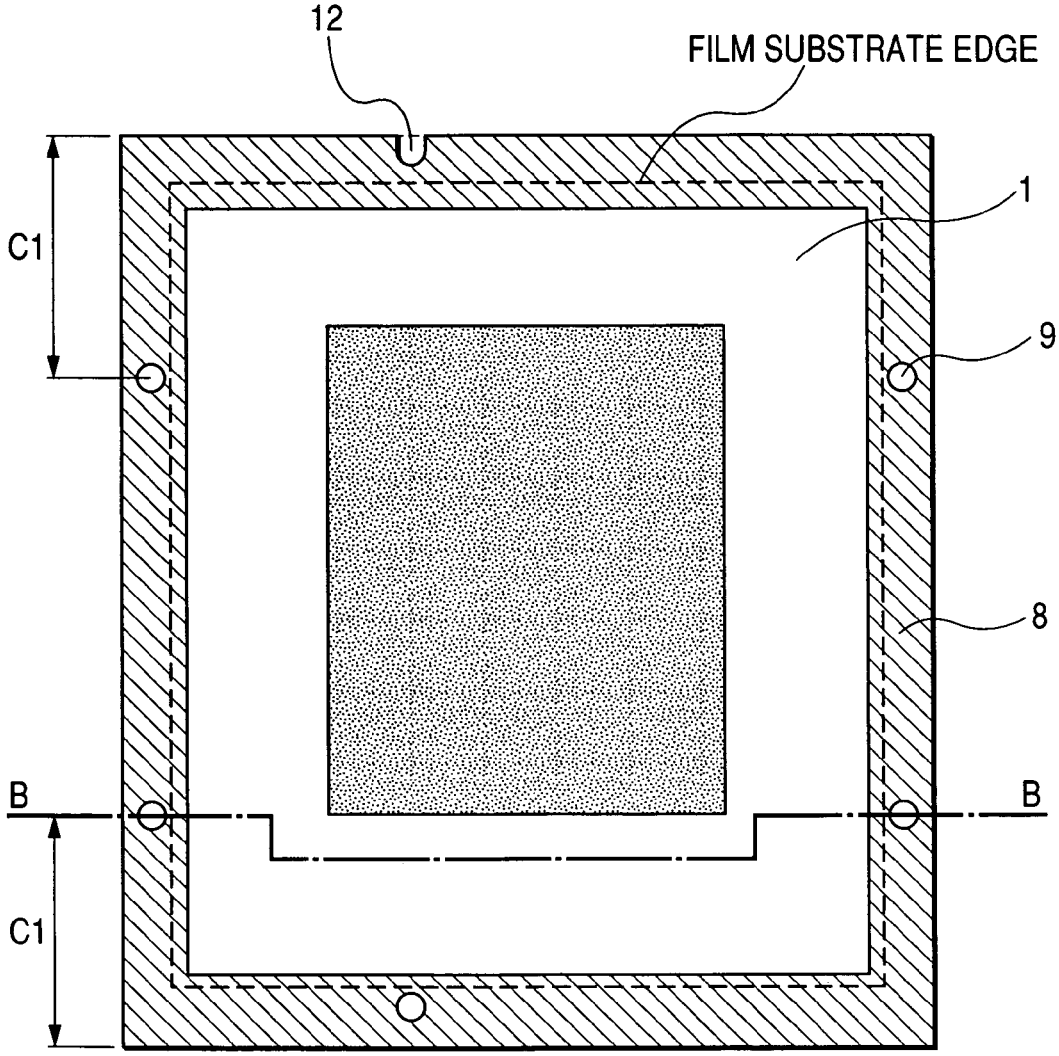
FIG. 7 is a plan view of FIG. 5.

Another embodiment of the substrate fixing frame is described in FIG. 5. A film substrate 1 is so constructed as to be sandwiched between two substrate fixing frames 14*a* and 14*b*, whereby the film substrate is readily attached or detached. In the structure, the position of the film substrate 1 is not changed, even though the substrate fixing frames 14*a* and 14*b* are inverted as shown in FIG. 5. Accordingly, it is necessary to form the positioning holes 9 in symmetrical positions, and to keep always the state that the positioning pins 10 are inserted therein as shown in FIG. 5. FIG. 7 is a plan view of FIG. 5.

Since the catalyst coated on the first surface of the film substrate is always on the same position by using the substrate holder and the substrate fixing frame, the catalyst can be coated on the second surface in the same pattern on the same position as on the first surface with good reproducibility.

Although coating of a catalyst solution to an electrolyte film which tends to swell has been described in this embodiment, this embodiment can be applied to coating of various solutions to paper, glass and metals in addition to the film.

In the above-embodiments, the catalyst solution is coated. However, the ink can be coated in the above-embodiment instead of the catalyst solution.

What is claimed is:

1. An apparatus for forming a thin film by coating a coating composition on a film substrate, the apparatus comprising:

a liquid jet mechanism having a liquid jet head for jetting the coating composition on the film substrate;

a moving mechanism capable of moving a position of the liquid jet head relatively to the film substrate;

a substrate fixing frame capable of fixing an edge portion of the film substrate; and a substrate holder having a mechanism for fixing and positioning the substrate fixing frame having the film substrate attached, and a mechanism for sucking the film substrate from a reverse side of a surface to which the coating composition is coated, wherein the substrate fixing frame is configured to be fixed to the entire edge portion of the film substrate.

2. A method for forming a thin film by coating a coating composition on a film substrate, the method comprising:

coating a coating composition on a first surface of the film substrate which is attached to the substrate fixing frame using the apparatus according to claim 1;

subsequently inverting the film substrate while being attached to the substrate fixing frame; and coating a coating composition on a reverse side of the first surface.

3. A method for forming a thin film by coating a coating composition on a film substrate, the method comprising:

coating a coating composition on a first surface of the film substrate which is attached to the substrate fixing frame using the apparatus according to claim 1;

subsequently inverting the film substrate while being attached to the substrate fixing frame; and coating a coating composition on a reverse side of the first surface by using the substrate fixing frame having a mechanism capable of positioning relating to the coating pattern of the first surface.

4. A method for forming a thin film by coating a coating composition on a film substrate, the method comprising:

coating a coating composition on a first surface of the film substrate which is attached to the substrate fixing frame using the apparatus according to claim 1;

subsequently inverting the film substrate while being attached to the substrate fixing frame; and coating a coating composition on a reverse side of the first surface.

5. A method for forming a thin film by coating a coating composition on a film substrate, the method comprising:

coating a coating composition on a first surface of the film substrate which is attached to the substrate fixing frame using the apparatus according to claim 1;

subsequently inverting the film substrate while being attached to the substrate fixing frame; and coating a coating composition on a reverse side of the first surface by using the substrate fixing frame having a mechanism capable of positioning relating to the coating pattern of the first surface.

6. An apparatus for forming a thin film according to claim 1, wherein the substrate fixing frame is invertible for coating a second side of the film substrate.

7. An apparatus for forming a thin film according to claim 6, wherein the substrate fixing frame includes a mechanism which positions the substrate fixing frame such that the second side corresponds to a coating pattern disposed on a first side.

8. An apparatus for forming a thin film according to claim 1, wherein the substrate holder comprises a heating mechanism attached thereto.

9. An apparatus for forming a thin film according to claim 1, wherein the film substrate comprises an upper part and a lower part, a portion of said film substrate being disposed between said upper part and said lower part.

10. An apparatus for forming a thin film according to claim 1, wherein the substrate holder further comprises a guide protrusion; and wherein the substrate fixing frame comprises a guide notch, said guide notch disposed such that alignment of the fixing frame and substrate holder is achieved when the guide notch and guide protrusion mate.

11. An apparatus for forming a thin film according to claim 1, wherein the substrate holder further comprises:

a plurality of pins; and a guide protrusion;

wherein the substrate fixing frame comprises a plurality of pin holes and a guide notch, wherein when a first side of the film substrate is positioned for coating, said plurality of pins are inserted into said plurality of pin holes, and wherein when a second side of the film substrate is positioned for coating, said substrate fixing frame rests on top of said plurality of pins, and the guide protrusion mates with the guide notch.

12. An apparatus for forming a thin film according to claim 1, wherein the substrate fixing frame comprises a plurality of positioning pins, and wherein the substrate holder comprises a plurality of positioning holes, such that the substrate fixing frame is properly positioned and fixed when said plurality of positioning pins are inserted into said plurality of positioning holes.

13. An apparatus for forming a thin film according to claim 1, wherein the substrate fixing frame comprises a positioning guide and a plurality of positioning holes, and wherein the substrate holder comprises a plurality of positioning pins, a positioning notch, and a step comprising a height substantially equal to a thickness of the substrate fixing frame.

14. An apparatus for forming a thin film according to claim 1, wherein the substrate fixing frame comprises a plurality of positioning pins, non-symmetrically disposed on the substrate fixing frame, wherein the substrate holder comprises:

a plurality of positioning holes non-symmetrically disposed on the substrate fixing frame, such that the substrate fixing frame is properly positioned and fixed when said plurality of positioning pins are inserted into said plurality of positioning holes;

a step comprising a height substantially equal to a thickness of the substrate fixing frame, and wherein, when the substrate fixing frame is inverted the plurality of positioning pins do not align with the plurality of positioning holes, such that the substrate fixing frame is disposed on the plurality of positioning pins and the film substrate rests on the step.

15. An apparatus for forming a thin film according to claim 1, wherein the sucking mechanism comprises a common sucking path which connects to a plurality of sucking holes.

16. An apparatus for forming a thin film according to claim 1, wherein the sucking mechanism connects to a sucking pipe, the sucking pipe connecting to a sucking pump.

17. An apparatus for forming a thin film by coating a coating composition on a film substrate, the apparatus comprising:

an ink jet mechanism having an ink jet head for jetting the coating composition on the film substrate;

a moving mechanism capable of moving a position of the ink jet head relatively to the film substrate;

a substrate fixing frame capable of fixing an edge portion of the film substrate; and a substrate holder having a mechanism for fixing and positioning the substrate fixing frame having the film substrate attached, and a mechanism for sucking the film substrate from a reverse side of a surface to which the coating composition is coated, wherein the substrate fixing frame is configured to be fixed to the entire edge portion of the film substrate.

* * * * *